US006663727B2

(12) United States Patent
Fujimura et al.

(10) Patent No.: US 6,663,727 B2
(45) **Date of Patent: *Dec. 16, 2003**

(54) STEEL ALLOY RAILWAY WHEELS

(75) Inventors: Takashi Fujimura, Nishinomiya (JP); Taizo Makino, Nishinomiya (JP)

(73) Assignee: Sumitomo Metal Industries, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/080,312

(22) Filed: Feb. 21, 2002

(65) Prior Publication Data

US 2002/0074065 A1 Jun. 20, 2002

Related U.S. Application Data

(62) Division of application No. 09/587,422, filed on Jun. 1, 2000, now Pat. No. 6,372,057.

(51) Int. Cl.[7] ..... C22C 38/708; C22C 38/06; C22C 38/02; C22C 38/18

(52) U.S. Cl. ..... 148/336; 148/320; 148/333; 148/334; 148/335

(58) Field of Search ..... 420/8, 104; 148/320, 148/333, 334, 335, 336

(56) References Cited

U.S. PATENT DOCUMENTS

| | | | | |
|---|---|---|---|---|
| 4,042,273 A | | 8/1977 | Heller et al. | |
| 4,364,772 A | * | 12/1982 | Niemond et al. | 420/104 |
| 5,565,044 A | | 10/1996 | Kim et al. | |
| 5,711,914 A | | 1/1998 | Heller | |
| 5,899,516 A | | 5/1999 | Fujimura et al. | |
| 6,372,057 B1 | * | 4/2002 | Fujimura et al. | 148/335 |

FOREIGN PATENT DOCUMENTS

| | | | | |
|---|---|---|---|---|
| DE | WO 0017529 | * | 6/1995 | C21D/8/00 |
| DE | 0198373311 A1 | * | 3/2000 | C22C/38/12 |

OTHER PUBLICATIONS

Sen et al., "Influence of Inclusions and Heat Treatment on Fatigue Strength of Wheel and Axle Steel," *Fatigue Design Symposium* (1998).

Danian et al., "The Effects of Cyclic Softening on the Shakedown Limit of Railway Wheel Steel," *International Conference on Mechanical Behaviour of Materials* ($6^{th}$), Kyoto, Japan (1992).

Bo et al., "Railway Wheel Rim Fatigue Break–Down and Relevant Problem," *$12^{th}$ International Wheelset Congress Proceedings*, Qingdao, China (Sep. 21–25, 1998).

Qian et al., "Fatigue of Railway Wheel and Its Damage," *$12^{th}$ International Wheelset Congress Proceedings*, Qingdao, China (Sep. 21–25, 1998).

Marais, "Wheel Failures on Heavy Haul Freight Wheels Due to Subsurface Defects," *$12^{th}$ International Wheelset Congress Proceedings*, Qingdao, China (Sep. 21–25, 1998).

(List continued on next page.)

*Primary Examiner*—Deborah Yee
(74) *Attorney, Agent, or Firm*—Leydig, Voit & Mayer, Ltd.

(57) ABSTRACT

Disclosed is a steel alloy that includes as alloying ingredients carbon, silicon, manganese, aluminum, and oxygen. In accordance with this embodiment of the disclosed invention, carbon is present in an amount ranging from 0.40 to 0.77 wt. %; silicon is present in an amount ranging from 0.40 to 1.20 wt. %; manganese is present in an amount ranging from 0.40 to 1.20 wt. %, aluminum is present in an amount ranging from 0.003 to 0.060 wt. %; and oxygen is present in an amount ranging up to 0.0030 wt. %. Also disclosed is a railway wheel that comprises a hub, a rim, and a connecting plate. In accordance with this embodiment of the disclosed invention, at least the rim, and preferably the entire railway wheel, is composed of the disclosed steel composition.

6 Claims, 1 Drawing Sheet

OTHER PUBLICATIONS

Lixian et al., "Study on Rim Fatigue Crack and Prevention," *12th International Wheelset Congress Proceedings*, Qingdao, China (Sep. 21–25, 1998).

Catot et al., "Contribution to Improve Steel Grades for Wheels for Heavy Freight Traffic," *International Wheelset Congress*, Sydney, Austtalia (Sep. 27–Oct. 1, 1992).

Sakamoto et al., "Simulation Test on Tread Shelling of Railroad Wheel," *Rail Transportation, 12*, pp. 73–78 (1996).

Ekberg et al., "Effects of Imperfections on Fatigue Initiation in Railway Wheels," *Charmec* (Oct. 21, 1999).

Gordon et al., "Evaluation of Service–Induced Residual Stresses in Railroad Commuter Car Wheels," *Rail Transportation, 15*, pp. 25–31 (1998).

Magel et al., "Controlling Wheel Shelling," *Railway Track & Structures* (Nov. 1997).

Snyder, "Shattered Rim Update," *Lab Notes* (Jul. 1998).

Diener et al., "Fracture Toughness of R7 Railroad Wheels," *La Metallurgia Italiana, 85* (3), pp. 161–167 (1993).

Sakamoto et al., "Fracture Toughness of Medium–High Carbon Steel for Railroad Wheels," *NSF–IMM Symposium on Micromechanic Modeling of Industrial Materials: In Honor of Professor T. Mori's 65th Birthday*, Seattle, Washington (Jul. 20–22, 1998).

Stone et al., "Wheel Thermal Damage Limits," *ASME, 1994*, pp. 57–63 (1994).

* cited by examiner

STEEL ALLOY RAILWAY WHEELS

This application is a divisional of case Ser. No. 09/587,422 filed Jun. 1, 2000 now U.S. Pat. No. 6,372,057 B1 issued Apr. 16, 2002.

FIELD OF THE INVENTION

The present invention relates generally to railway wheels, and more particularly, to chemical steel compositions for use in manufacturing railway wheels and rims.

BACKGROUND OF THE INVENTION

Numerous steel compositions are known for use in manufacturing wheels for railway cars. Recently, the volume of railway freight transportation, sometimes referred to in terms of railroad freight revenue ton-miles, is increasing to meet an increasing rail transport demand. As a result, rail cars are hauling increasingly heavier average loads. The load on the wheels of such heavy haul rail cars often approaches permissible limits, leaving little safety margin for wheel loading.

One serious problem with railway wheels is known as shattered-rim fracture. Shattered-rim fracture is a phenomenon whereby a rolling contact fatigue crack initiating at an internal defect in a wheel rim subsurface propagates from the crack ultimately to cause substantial damage to the wheel. Left unchecked, the shattered-rim fracture can cause catastrophic failure of the railway wheel and derailment of the rail car. This problem can be exacerbated as the load on the wheel or the speed of travel increase. The tendency towards shattered-rim fracture in a railway wheel also can be affected by transient effects caused by unbalanced loads, heavy braking, and other circumstances, and is becoming more of a concern with increasing railway transportation.

Shattered-rim fracture is believed to stem from internal defects in the railway wheel, such as inclusions, pores, voids, vacancies, cavities, or pinholes. The driving force of the fracture is believed to be cyclic shear stress caused by contact loading on the rim. Such stress is thought to cause Mode II (in-place shearing) crack propagation from internal defects in the wheel rim, a phenomenon in which cracks propagate from a defect in the rim when the Mode II stress intensity factor range is greater than the threshold Mode II stress intensity factor range for the rim. For this reason, railway wheels should be manufactured such that the size of internal defects is kept as small as possible, particularly in the wheel rim. While the permissible defect size for a given railway wheel may depend on factors such as diameter of the wheel and the wheel loading, in most cases, it is believed that the defect size, i.e., the diameter of the void, inclusion, or the like in the railway wheel rim, should be kept below about 1.5 mm. in size.

OBJECTS AND SUMMARY OF THE INVENTION

It is an object of the present invention to provide a railway car wheel that is resistant to shattered-rim fracture during long term heavy haul usage.

Another object is to provide a steel composition that enables the manufacture of railway wheels that are more resistant to shattered-rim fracture.

A further object is to provide a steel composition as characterized above which is less susceptible than conventional steel compositions to formation of voids, inclusions, or like defects in the finished product.

A related object is to provide a steel composition that can be consistently formed into railway wheels with voids, inclusions, and like defects in the rim that do not exceed 1.5 mm in size.

In carrying out these objects, a steel composition has been discovered, which according to the invention, consists essentially of iron, 0.40 to 0.77 wt. % carbon, 0.25 to 0.60 wt. % silicon, 0.40 to 1.20 wt. % manganese, 0.003 to 0.060 wt. % aluminum, and up to 0.0030 wt. % oxygen, with other alloying ingredients preferably not being present, or being present only in limited quantities as described in more detail hereinbelow. The invention also encompasses a railway wheel that generally comprises a rim, a hub, and a plate that connects the rim to the hub, with at least the rim, and preferably the entire wheel, being composed of the steel composition of the invention. Surprisingly, a steel alloy composed of the foregoing ingredients may be forged to form a railway wheel in which the size of internal defects, such as inclusions, voids, and the like, may be minimized and maintained within acceptable standards.

Other objects and advantages of the invention will become apparent upon reading the following detailed description and upon reference to the drawings, in which:

Figure 1:
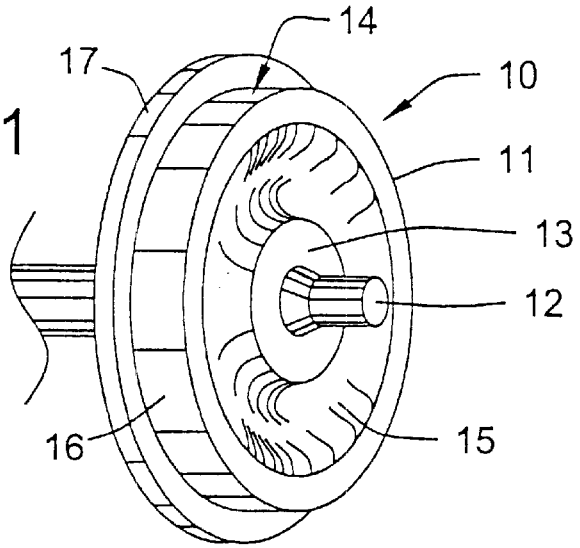
FIG. 1 is a fragmentary perspective of a railway wheel set having wheels in accordance with the present invention, one of the wheels being illustrated.
Figure 2:
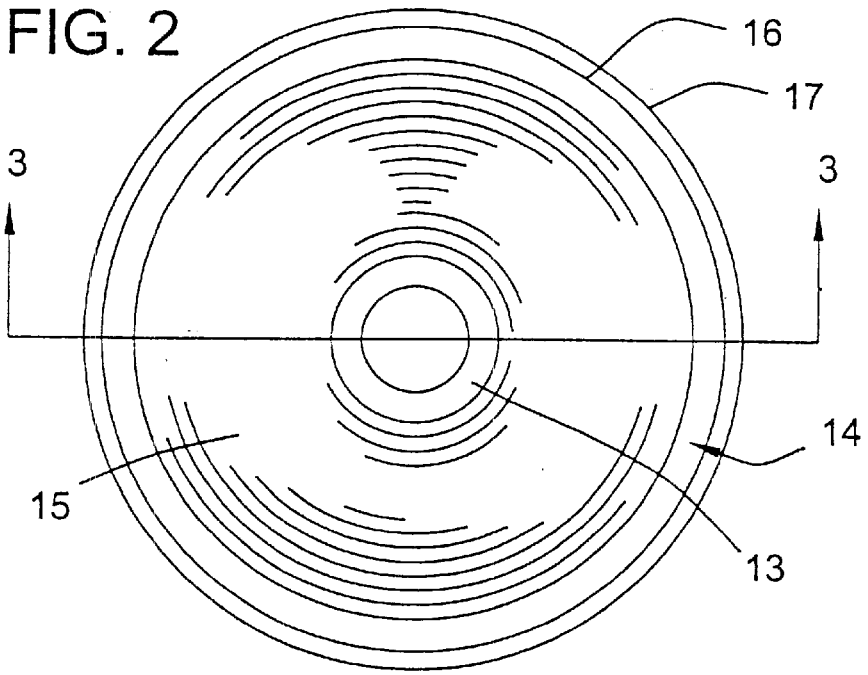
FIG. 2 is a side elevational view of the railway wheel shown in FIG. 1.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENTS

Generally, the steel composition of the invention consists essentially of iron with other alloying ingredients as discussed herein. It is contemplated that other ingredients, such as impurities in the iron or other elements, may be present in the steel composition, so long as the general properties of the steel composition and usefulness of the composition in a railway wheel are not affected. More particularly, in accordance with the invention, a steel composition is provided that consists essentially of iron, carbon, silicon, manganese, and aluminum, with oxygen present only up to a limited amount, and having a steel microstructure that preferably is a pearlite phase. The composition can be forged or otherwise formed into railway wheels that are adapted for long term reliable usage in heavy haul freight transportation.

Carbon preferably is present as an iron alloying ingredient in the steel composition in an amount ranging from 0.40 to 0.77 weight percent (wt. %). It is believed that when carbon is present in amounts below 0.40 wt. %, the wear resistance of the steel composition will be adversely affected. The amount of carbon preferably is limited to 0.77 wt. % to avoid the separation of a cementite (FeC) phase, which, it is believed, would tend to reduce the toughness of the composition.

Silicon is included in the composition of the invention in a preferred amount ranging from 0.25 to 0.60 wt. %. At least 0.25 wt. % silicon is desired for imparting wear resistance. Silicon also is believed to lower the Mode II threshold stress intensity factor range ($\Delta K_{IITH}$) for the steel composition if present below 0.25 wt. %, a circumstance which would allow cracks to propagate more easily. It is desired to limit the silicon content to 0.60 wt. % to avoid tendency of the microstructure to transform into a bainite phase, which it is believed likely could cause spalling defects in treads of the wheel rim during running and/or braking operations.

Manganese is included in the composition of the invention to improve hot workability of the steel composition. At least 0.40 wt. % manganese is desirable for this purpose. When this element is present in an amount greater than 1.20 wt. %, the benefits of hot workability are not believed to increase, and moreover, such greater amounts may lead to decreased machining performance and disruption of the pearlitic microstructure due to formation of a bainite phase. The preferred range of manganese in the alloy thus is 0.40 to 1.20 wt. %.

The composition of the invention includes aluminum in a preferred amount ranging from 0.003 wt. % to 0.060 wt. %. The aluminum should be present in these amounts to improve fracture toughness of the steel composition. It is believed that the amount of aluminum should be limited to 0.060 wt. % to mitigate against formation of inclusions in the composition.

The composition of the invention includes oxygen in amounts ranging up to 0.0030 wt. %, preferably, in amounts ranging from 0.0005 wt. % to 0.0030 wt. %. It is believed that the amount of oxygen should be limited to 0.0030 wt. % to further mitigate against formation of inclusions in the steel composition. At present, 0.0005 wt. % is the lowest oxygen content that is believed to be commercially practicable.

Other alloying ingredients preferably are not present, or are present in amounts as low as can be made commercially practicable. For example, phosphorous preferably is present in a maximum amount of 0.030 wt. %. At present, it is believed to be commercially impractical to remove phosphorous below 0.005 wt %, and, thus the most preferred range of phosphorous is 0.005 wt. % to 0.030 wt. %. When phosphorus is present in amounts above 0.030 wt. %, it is believed that the presence of this element may cause microsegregation within the steel composition, which may decrease the fracture resistance of the steel composition.

Sulfur preferably is present in a maximum amount of 0.030 wt. %, and more preferably, in an amount ranging from 0.005 wt. % to 0.030 wt. %. Sulfur can improve machining when present in amounts greater than 0.005 wt. %. It is believed that sulfur should be present in an amount limited to a maximum of 0.030 wt. % to mitigate against formation of inclusions in the composition.

The steel composition preferably includes a maximum of 0.35 wt. % copper to mitigate against fracture during hot forging, and a maximum of 0.35 wt. % nickel to mitigate against generation of adhesive scale and the formation of bainite phase during forging or hot processing of the steel composition. More preferably, the amount of nickel in the composition is kept to a maximum of 0.15 wt. %. In commercial compositions, nickel preferably is present in an amount ranging from 0.01 to 0.15 wt. %, inasmuch as it is not believed to be commercially practicable at present to remove nickel to levels below 0.01 wt. %.

Chromium is preferably present in a maximum amount of 0.35 wt. %, and more preferably, in amounts ranging from 0.03 to 0.35 wt. %. Chromium is believed to impart wear resistance when used in amounts within this range. It is believed desired to limit the amount of chromium to 0.35 wt. % to mitigate against formation of a bainite phase.

Molybdenum is preferably not present in the composition. If present, this element preferably is present in an amount ranging up to 0.10 wt. %. It is believed that when molybdenum is present in an amount greater than 0.10 wt. %, the presence of this element may avoid the tendency of the microstructure to transform into a bainite.

Other generally undesired elemental ingredients are boron, vanadium, titanium, calcium, niobium, and hydrogen. The steel composition preferably includes a maximum of 0.005 wt. % boron. It is believed that the thermal crack resistance of the steel composition will be adversely affected when boron is present in greater amounts. Vanadium, niobium and titanium each preferably are present in a maximum amount of 0.10 wt. %, inasmuch as it is believed that the presence of these elements in greater amounts may decrease the toughness of the steel composition. Calcium is preferably kept to a maximum amount of 0.0050 wt. %. It is believed that the presence of this element in greater amounts may cause formation of oxide inclusions in the steel composition. The steel composition preferably includes a maximum amount of hydrogen of 0.00025 wt. % so as to mitigate against the phenomenon known as hydrogen brittle fracture.

Finally, it is believed that the composition preferably should include a maximum amount of nitrogen of 0.0150 wt. %, more preferably, 0.0015 to 0.0150 wt. %. The pressure of this element may cause surface defects during steel production when used in greater amounts. The amount of nitrogen in the composition may be greater than 0.0015 wt. % so as not to decrease the toughness of the composition.

The invention is further contemplated to encompass steel compositions that include amounts of any of the foregoing ingredients slightly outside of the ranges given, as well as possibly other alloying ingredients or impurities, so long as the basic suitability of the composition for use in the manufacture of railway wheels and rims is not affected. It is contemplated that the amount of iron in the composition may range up to nearly 99% and may be as low as about 95.0% due to the presence of impurities.

Referring now more particularly to the drawings, there is shown an illustrative railway wheel set 10 having wheels in accordance with the invention. The illustrated wheel set 10 includes a pair of railway wheels (one of which is shown as wheel 11) mounted on a common axle 12. It will be understood that the illustrated wheel set 10 could be used with any railroad car or engine, as well as other transport vehicles.

Figure 3:
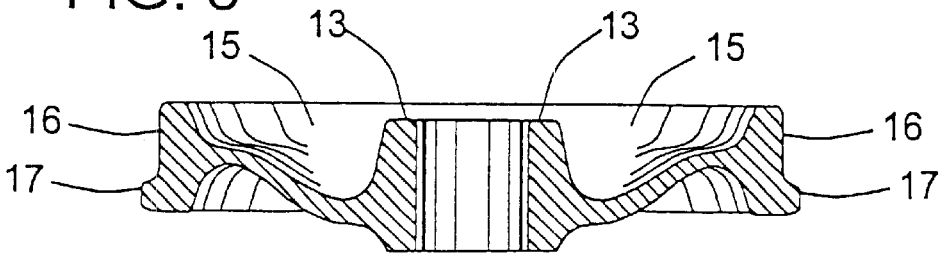
FIG. 3 is a section of the railway wheel shown in FIG. 2, taken in the plane of line 3—3.

The illustrated wheel 11 comprises a hub 13 mounted on the axle 12, a peripheral rim 14, and a connecting plate 15 interposed between the hub 13 and rim 14. The illustrated plate 15 preferably has a sigmoid or "s-shape," as can be seen in FIG. 3, and the rim 14 includes a tread 16 and flange 17 of a conventional type. It will be understood by one skilled in the art that the plate, hub and rim may be configured differently as desired for a given railway application.

In accordance with the invention, at least the rim (for instance, in the case of a composite wheel), and more preferably the entire wheel (as shown in the Figures), is composed of the steel alloy of the invention. In carrying out this embodiment of the invention, any suitable casting and/or forging process may be used to fabricate the railway wheel or rim. For instance, the railway wheel may be manufactured using a conventional rotary dishing press. A suitable forging procedure is disclosed in "User-Producer Phase II Rolling Stock Technology," *Proceedings of the International Union of Railways*, Tehran, Iran (Nov. 18–22, 1996), the disclosure of which is hereby incorporated by reference in its entirety. In accordance with this embodiment of the invention, railway wheels are manufactured in a semi-continuous process in which pig iron is converted to steel, degassed, and cast into a casting in a continuous casting machine. The steel casting is then cut into steel blocks, which are heated and forged into rough wheel blanks. The blanks are subsequently rolled to form rough wheels, which then are dished and pierced by a dishing press. One suitable dishing press is the SIRD (Sumitomo Inclined Rotary Dishing press), manufactured by Sumitomo Metal Industries, Ltd. The rolls then are cooled slowly, and are reheated, quenched, and tempered. The wheels are then tested and machined in accordance with known procedures.

It should be understood that other wheel fabricating processes as are known in the art, or as otherwise may be found suitable, may be used to prepare the railway wheels. For example, when the wheel of the invention takes the form of a composite wheel, conventional or otherwise suitable processes for the fabrication of such composite wheels may be employed.

Railway wheels can be forged or otherwise formed from the steel composition of the invention such that the size of internal defects, such as inclusions, voids, and the like, can be maintained within acceptable standards. More particularly, the composition may be used to prepare a wheel or rim in which the size of internal defects, such as inclusions, voids, and the like are maintained below 1.5 mm. The railway wheel or rim thus prepared is resistant to shattered-rim fracture even during long term, heavy haul freight usage.

From the foregoing, it can be seen that the foregoing general objects have been satisfied. The invention provides both a steel composition and a railway wheel. The railway wheel of the invention is adapted for reliable heavy haul uses required by the present increasing rail transport demand. The steel composition of the invention, furthermore, unexpectedly enables the manufacture of such railway wheels with internal defects of a substantially reduced size. While the invention has been disclosed in connection with railway wheels, it is contemplated that the steel composition of the present invention may be used in other applications.

What is claimed is:

1. A railway wheel comprising a rim, a hub, and a connecting plate between said rim and said hub, wherein at least the wheel rim is composed of a composition consisting essentially of:

0.40 to 0.77 wt. % carbon,
0.25 to 0.60 wt. % silicon,
0.40 to 1.20 wt. % manganese,
0.003 to 0.060 wt. % aluminum,
up to 0.030 wt. % phosphorus,
up to 0.030 wt. % sulfur,
up to 0.35 wt. % nickel,
up to 0.35 wt. % chromium,
up to 0.35 wt % copper,
up to 0.0050 wt. % calcium,
0.0015 to 0.0150 wt. % nitrogen,
and inevitable impurities and balance iron.

2. The railway wheel of claim 1 which said composition includes up to 0.10 wt. % titanium.

3. The railway wheel of claim 2 in which said composition includes up to 0.10 wt. % molybdenum, up to 0.005 wt. % boron, up to 0.10 wt % vanadium, up to 0.10 wt. % niobium, 0.0005 to 0.0030 wt. % oxygen, and up to 0.00025 wt. % hydrogen.

4. A railway wheel comprising a rim, a hub, and a connecting plate between said rim and said hub, wherein at least the wheel rim is composed of a composition consisting essentially of:

0.40 to 0.77 wt. % carbon,
0.25 to 0.60 wt. % silicon,
0.40 to 1.20 wt. % manganese,
0.003 to 0.060 wt. % aluminum,
up to 0.030 wt. % phosphorus,
0.005 wt. % to 0.030 wt. % sulfur,
0.01 to 0.35 wt. % nickel,
up to 0.35 wt. % chromium,
up to 0.35 wt % copper,
up to 0.0050 wt. % calcium,
0.0015 to 0.0150 wt. % nitrogen,
and inevitable impurities and balance iron.

5. The railway wheel of claim 4 in which said composition includes up to 0.10 wt. % titanium.

6. The railway wheel of claim 5 in which said composition includes up to 0.10 wt. % molybdenum, up to 0.005 wt. % boron, up to 0.10 wt % vanadium, up to 0.10 wt. % niobium, 0.0005 to 0.0030 wt. % oxygen, and up to 0.00025 wt. % hydrogen.

* * * * *